United States Patent [19]

Leichter et al.

[11] 4,356,244

[45] Oct. 26, 1982

[54] QUINOXALINE CYANINE DYE SENSITIZED ORGANIC ELECTRON DONOR COMPOUNDS

[75] Inventors: Louis M. Leichter, Woodbury; Terry J. Sonnonstine, White Bear Lake; John J. Stofko, Jr., St. Paul, all of Minn.; Paolo Beretta, Ferrania, Italy

[73] Assignee: Minnesota Mining and Manufacturing Company, St. Paul, Minn.

[21] Appl. No.: 236,653

[22] Filed: Feb. 23, 1981

[51] Int. Cl.[3] ..... G03G 5/06

[52] U.S. Cl. ..... 430/82; 430/71; 430/75; 430/81; 430/106; 430/110; 430/83; 252/501.1

[58] Field of Search ..... 430/900, 58, 81, 82, 430/83, 110, 71, 75, 106

[56] References Cited

U.S. PATENT DOCUMENTS 4,264,694 4/1981 Pu et al. ..... 430/58

*Primary Examiner*—John D. Welsh

*Attorney, Agent, or Firm*—Cruzan Alexander; Donald M. Sell; Mark A. Litman

[57] ABSTRACT

Organic electron donor compounds for use in electrophotographic constructions must ordinarily be sensitized to desired regions of the electromagnetic spectrum. Imidazo[4,5-b] quinoxaline cyanine dyes having phenylsulfonyl or benzoyl substituents have been found to be efficient sensitizers for such organic donor compounds.

16 Claims, No Drawings

QUINOXALINE CYANINE DYE SENSITIZED ORGANIC ELECTRON DONOR COMPOUNDS

TECHNICAL FIELD

The present invention relates to novel photoconductive layers which comprise organic electron donor compounds and phenylsulfonyl or benzoyl substituted imidazo-[4,5-b]-quinoxaline sensitizer dyes. These layers are particularly useful in imaging systems such as electrophotography or electroradiography.

BACKGROUND OF THE ART

The technology of electrophotography is commercially well established. A wide variety of processes and apparatus are used, although they have many characteristics in common. One of the more common forms of this technology involves the use of a plate having a photoconductive insulating layer, generally coated on a conductive layer. Imaging is effected by first uniformly electrostatically charging the surface of the photoconductive layer and then exposing the charged layer to an image or pattern of activating electromagnetic radiation, usually visible light or ultraviolet radiation. This exposure selectively enables the charge in the irradiated areas of the photoconductive insulator to dissipate. The charge which remains in the non-irradiated areas forms a latent image which may be further processed to form a more permanent record of the exposing image or pattern. The most common form of additional processing involves the attraction of particles of material selectively to the charged areas and fusing them to the photoconductive layer or transferring the particles in their imagewise distribution to another surface to which they are more permanently bound by an adhesive or by fusion of the particles themselves. A common electrophotographic construction comprises, in sequence, a substrate, a conductive layer, and a photoconductive insulating layer.

Typical classes of photoconductive materials useful in electrophotography include (1) inorganic crystalline photoconductors such as cadmium sulfide, cadmium sulfoselenide, cadmium selenide, zinc sulfide, zinc oxide, and mixtures thereof, (2) inorganic photoconductive glasses such as amorphous selenium, selenium alloys, and selenium-arsenic, and (3) organic photoconductors such as phthalocyanine pigments and polyvinyl carbazole, with or without binders and additives which extend their range of spectral sensitivity. These systems are well known in the art. For example, U.S. Pat. No. 3,877,935 discusses various problems associated with the crystalline and amorphous classes of photoconductors and shows the use of polynuclear quinone pigments in a binder as a photoconductive layer. U.S. Pat. No. 3,824,099 shows the use of squaric acid methine sensitizing dyes and triaryl pyrazoline charge transport materials as an electrophotographic construction. Cadmium sulfoselenide plates are shown in U.S. Pat. No. 3,764,315, and one of the original disclosures of the use of poly-N-vinylcarbazole as a photoconductive insulating layer is provided in U.S. Pat. No. 3,037,861. A number of diverse organic photoconductors have been disclosed since the development of the carbazole class of photoconductors such as quinones and anthrones (e.g., Hayashi et al., *Bull. Chem. Soc. Japan*, vol. 39, (1966) pp. 1670–1673), but the carbazoles have continued to attract the greatest attention.

Problems particularly associated with the use of carbazoles as a positive charge transporting material which is capable of supporting the injection of photoexcited holes from a photoconductive layer and is capable of transporting the injected holes also exist in this area of technology. The carbazole condensates with aldehydes as shown in U.S. Pat. No. 4,025,341 have a tendency to oligomerize. This oligomerization can cause a number of problems. The oligomers formed are not of a uniform molecular weight and carbazole content. This creates problems in purification and can create undesirable variations in photoconductive or charge transport properties. Triaryl methanes including a carbazole moiety (as shown in Xerox Disclosure Journal, Vol. 3, No. 1, January/February 1978, page 7) also tend to be sensitive to oxidation which converts them to an ionic species which will not act as a photoconductive insulator but rather will act as a conductor.

Japanese Patent Publication No. 52-34735 discloses carbazole organic photoconductor materials which may have substituents thereon which would inherently prevent oligomerization of the carbazoles. This is not recognized in the disclosure and the carbazoles would still be subject to oxidation problems.

SUMMARY OF THE INVENTION

Electronically active organic donor compounds have been found to be sensitized by phenylsulfonyl or benzoyl substituted imidazo-[4,5-b]-quinoxaline cyanine dyes.

A novel class of electronically active organic donor compounds particularly useful in the present invention has the formula:

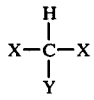

where X is

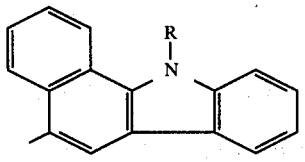

or

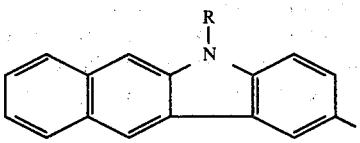

wherein R is an aliphatic, aromatic, or mixed aliphatic-aromatic group and Y is an aliphatic, aromatic, heterocyclic, or mixed aliphatic-aromatic group. For example, R and Y may be independently selected from alkyl groups, benzyl groups, phenyl groups, naphthyl groups, anthracyl groups, etc., with such various substituents as alkoxy groups, amine groups, alkyl groups, hydroxyl groups, and halogen atoms thereon.

These compounds have been found to be electron donor compounds and are useful in forming photoconductive layers when sensitized with cyanine dyes having an imidazo-[4,5-b]quinoxaline nucleus. They may be combined with polymeric binder materials to form photoconductive layers which are solid state molecular solution charge transport layers. The electron donor compounds have a reduced sensitivity to oxidation and oligomerization.

DETAILED DESCRIPTION OF THE INVENTION

All electronically active organic donor compounds, as they are known in the art, may be sensitized to various portions of the electromagnetic spectrum by imidazo-[4,5-b]-quinoxaline cyanine dyes. Typical electronically active organic electron donor compounds are poly-N-vinylcarbazole, polyanthracene, oxadiazoles, pyrazolines, poly(vinyl acenaphthalene), poly-2,9-methylene fluorene, polyvinyl ferrocene, polybenzocarbazole, polybenzoanthracene, and the like.

Novel electronically active organic donor compounds useful in the practice of the present invention are bis (benzocarbazoles)trisubstitutedmethanes which may be represented by the formula

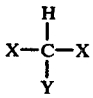

wherein X is

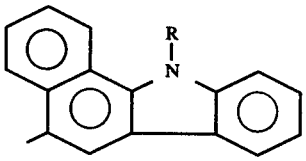

or

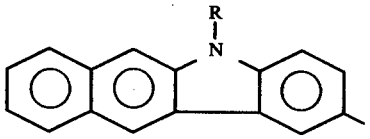

wherein

R is an aliphatic, aromatic or mixed aliphatic-aromatic group and

Y is an aliphatic, aromatic, heterocyclic or mixed aliphatic-aromatic group.

All of the compounds of the present invention may be synthesized by reacting the appropriate N-substituted benzo[a]carbazole or benzo[b]carbazole:

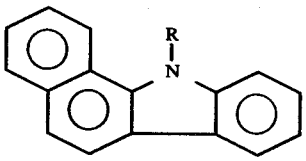

or

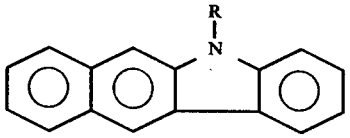

with the correspondingly appropriate aldehyde:

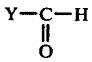

This process can be carried out in a solvent (e.g., ethanol) in the presence of an acid (e.g., HCl) catalyst. The reaction product may be isolated by simple filtration and washing. For example, in the reaction of 11-ethylbenzo[a]carbazole with benzaldehyde in ethanol in the presence of HCl as a catalyst, the preferential reaction of the aldehyde at the 5-position of the 11-benzo[a]carbazole and the insolubility of the reaction product:

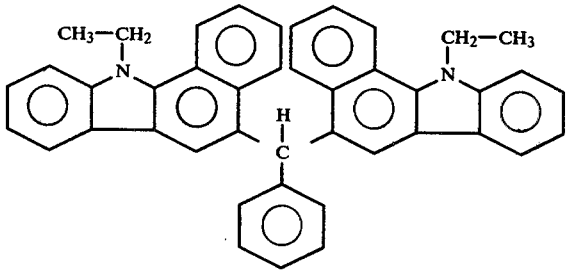

in ethanol, no oligomeric species are formed such as occur in a similar reaction with N-ethyl-carbazole. The reaction product is also stabilized against oxidation of the methine group by the rings ortho to point at which the methine group is bonded to the benzocarbazole nucleus.

R may, as previously stated, be selected from aliphatic, aromatic and mixed aliphatic-aromatic groups. These groups may or may not be substituted. If they are substituted, it would be preferred that they be electron donating substituents although election withdrawing substituents may be tolerated. Preferably R is selected from alkyl groups of 1 to 20 carbon atoms, preferably n-alkyl groups of 2 to 20 carbon atoms, aryl groups such as phenyl or naphthyl groups, with phenyl groups preferred, alkaryl groups, for example benzyl groups, and allyl groups. Where the term 'group' is used anywhere in the practice of the present invention, as opposed to the term 'radical', the possibility of substitution is specifically intended to be included within the definition of that term. For example, n-alkyl radical may be only of the formula $-(CH_2)_n-CH_3$ while n-alkyl group may have hydrogen atoms on the n-alkyl radical substituted with other moieties such as halogen atoms, hydroxyl radicals, alkoxy radicals, alkyl radicals, amine radicals, cyano radicals, etc. Specific examples of useful R moieties are ethyl, n-butyl, n-propyl, 4-methoxybutyl, 3-chloropropyl, 8-hydroxyoctyl, phenyl, benzyl, allyl, p-ethylphenyl, m-tert-butylnaphthyl, p-diethylaminophenyl, stearyl, dodecyl, etc. R preferably has fewer than 20 carbon atoms, but may have up to 30 or more carbon atoms. The main influence of this group, except where electronic induction occurs because of a change of the nature of this group, is in the solubility of the compound.

Y may, as previously stated, be selected from aliphatic, aromatic, and mixed aliphatic-aromatic groups. These groups may or may not be substituted. Examples of useful moieties are methyl, ethyl, n-pentyl, nonyl, stearyl, tolyl, anisyl (m-, p-, and o-), p-chlorobenzyl, o-bromobenzyl, p-hydroxybenzyl, veratryl, isobutyl, terphthalyl, p-octyloxybenzyl, p-dimethylaminophenyl, t-butyl, etc. Preferred Y moieties are phenyl, tolyl, anisyl, and benzyl groups because of their availability. As with group R, the main influence of this group, except with regard to electron induction effects, is on the solubility of the compounds. Preferably Y has 20 or fewer carbon atoms, but up to 30 may be readily tolerated. These compounds are disclosed in a commonly assigned U.S. Patent Application Ser. No. 237,068, filed in the name of John J. Stofko, Jr. et al. on the same day as this application.

The imidazo-[4,5-b]quinoxaline cyanine sensitizers which are a part of the present invention are disclosed in British Pat. No. 1,555,053. This reference teaches cyanine dyes in silver halide emulsions or photoconductive binders as sensitizer dyes.

The dyes may be represented by the formulae described in British Pat. No. 1,555,053 which reference is incorporated herein in its entirety, and preferred dyes by the formulae:

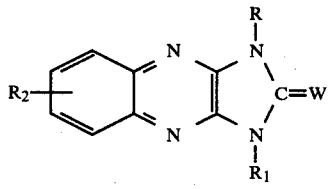

wherein W represents:

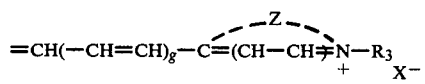

(I)

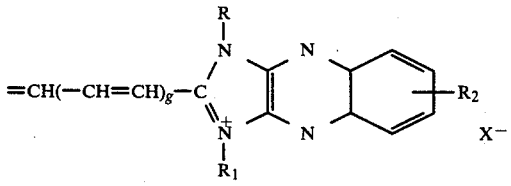

(II)

(this formula being a particular case of formula I)

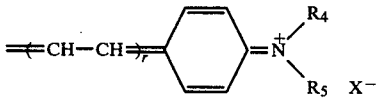

(III)

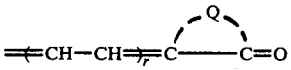

(IV)

(V)

wherein g represents a positive integer of from 1 to 3 (preferably 1 to 2), and r represents a positive integer of from 1 to 2, R and $R_1$ each represents a substituent independently selected from the group consisting of an acyclic hydrocarbon substituent, such as an alkyl group (including substituted alkyl), preferably containing from 1 to 13 carbon atoms, e.g. methyl, ethyl, propyl, isopropyl, butyl, sec-butyl, hexyl, cyclohexyl, dodecyl, octadecyl, hydroxyalkyl (e.g. ω-hydroxyethyl, ω-hydroxypropyl, etc.), and alkenyl substituents, such as allyl, 1-propenyl, 2-propenyl, 1-butenyl, 2-butenyl and 3-butenyl, etc.; alkaryl substituents such as benzyl and ω-phenylethyl; and aryl substituents, e.g., phenyl, p-tolyl, o-tolyl, 3,4-dichlorophenyl, etc., groups; $R_2$ represents a 6- or 7-position substituent selected from phenylsulfonyl or benzoyl; $X^-$ represents an acid anion such as for example, in order of general preference perchlorate, tetrafluoroborate, p-toluenesulfonate, methylsulfate, sulfamate, iodide, bromide, and chloride; $R_3$ represents a substituted or non-substituted aliphatic group such as an alkyl group of from 1–12 carbon atoms, e.g., methyl, γ-sulfopropyl, isopropyl, butyl, sec-butyl, ω-sulfobutyl, dodecyl, β-hydroxyethyl, γ-hydroxypropyl, β-methoxyethyl, β-ethoxy-ethyl, allyl, benzyl, β-phenylethyl, β-carboxyethyl, carboxymethyl, γ-carboxypropyl, β-acetoxyethyl, γ-acetoxypropyl, carbomethoxymethyl, carboxyethoxyethyl, etc., groups; $R_4$ and $R_5$ each represents the same or different alkyl group of from 1–6 carbon atoms, e.g., methyl, ethyl, 2-cyanoethyl, propyl, isopropyl, butyl, hexyl, etc., groups, X represents any anion such as an acid ion, e.g., chloride, bromide, iodide, thiocyanate, sulfamate, methyl sulfate, ethyl sulfate, perchlorate, p-toluenesulfonate, etc., Z represents the non-metallic atoms required to complete a heterocyclic nucleus containing from 5 to 6 atoms in the heterocyclic ring, which may also include, in addition to the hetero nitrogen atom, a second hetero atoms such as an oxygen atom, a sulfur atom, a selenium atom, or a second nitrogen atom, such as the atoms required to complete a thiazole nucleus (e.g., thiazole, 4-methylthiazole, 4-phenyl-thiazole, 5-methylthiazole, 5-phenylthiazole, 4,5-dimethylthiazole, 4,5-diphenylthiazole, 4-(2-thienyl)thiazole, etc.); a benzothiazole nucleus (e.g., benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 4-phenylbenzothiazole, 5-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, tetrahydrobenzothiazole, 5,6-dimethoxybenzothiazole, 5,6-dioxymethylenebenzothiazole, 5-hydroxybenzothiazole, 6-hydroxybenzothiazole, etc.); a napthothiazole nucleus (e.g., α-naphthothiazole, β-naphthothiazole, 5-methoxy-β-naphthothiazole, 5-ethoxy-β-naphthothiazole, 8-methoxy-α-naphthothiazole, 7-methoxy-α-naphthothiazole, etc.); a thianaphtheno-7′,6′, 4,5-thiazole nucleus (e.g., 4′-methoxythianaphtheno-7′,6′, 4,5-thiazole, etc.); an oxazole nucleus (e.g., 4-methyloxazole, 5-methyloxazole, 4-phenyloxazole, 4,5-diphenyloxazole, 4-ethyloxazole, 4,5-dimethyloxazole, 5-phenyloxazole, etc.); a benzoxazole nucleus (e.g., benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole, 5-methoxybenzoxazole, 5-ethoxybenzoxazole, 6-chlorobenzoxazole, 6-methoxybenzoxazole, 5-hydroxybenzoxazole, 6-hydroxybenzoxazole, etc.); a naphthoxazole nucleus (e.g., α-naphthoxazole, β-naphthoxazole, etc.); a selenazole nucleus (e.g., 4-methylselenazole, 4-phenylselenazole, etc.); a benzoselenazole nucleus (e.g., benzoselenazole, 5-chlorobenzoselenazole, 5-methoxybenzoselenazole, 5-hydroxybenzoselenazole tetrahydrobenzoselenazole, etc.); a naphthoselenazole nucleus (e.g., α-naphthoselenazole, β-naphthoselenazole, etc.); a thiazoline nucleus (e.g., thiazoline, 4-methylthiazoline, etc.); a 2-quinoline nucleus (e.g., quinoline, 3-methylquinoline, 5-methylquinoline, 7-methylquinoline, 8-methylquinoline, 6-chloroquinoline, 8-chloroquinoline, 6-methoxyquinoline, 6-ethoxyquinoline, 6-hydroxyquinoline, 8-hyroxyquinoline, etc.); a 4-quinoline nucleus (e.g., quinoline, 6-methoxyquinoline, 7-methylquinoline, 8-methylquinoline, etc.); a 1-isoquinoline nucleus (e.g., isoquinoline, 3,4-dihydroisoquinoline, etc.); a 3-isoquinoline nucleus (e.g., isoquinoline, etc.); a 3,3-dialkylindolenine nucleus (e.g., 3,3-dimethylindolenine, 3,3,5-trimethylindolenine, 3,3,7-trimethylindolenine, etc.); a 2-pyridine nucleus (e.g., pyridine, 3-methylpyridine 4-methylpyridine, 5-methylpyridine, 3,4-dimethylpyridine, 4-chloropyridine, 3-hydroxypyridine, 3-phenylpyridine, etc.); a 4-pyridine nucleus (e.g., 2-methylpyridine, 3-methylpyridine, 3-chloropyridine, 2,6-dimethylpyridine, 3-hydroxypyridine, etc.); a 1-alkylimidazole nucleus (e.g., 1-methylimidazole, 1-ethyl-4-phenylimidazole, 1-butyl-4,5-dimethylimidazole, etc.); a 1-alkylbenzimidazole nucleus (e.g., 1-methylbenzimidazole, 1-butyl-4-methylbenzimidazole, 1-ethyl-5,6-dichlorobenzimidazole, etc.); and a 1-alkylnaphthimidazole nucleus (e.g., 1-ethyl-α-naphthimidazole, 1-methyl-β-naphthimidazole, etc.); and, Q represents the non-metallic atoms required to complete a 5 to 6 membered heterocyclic nucleus, typically containing a hetero atom selected from nitrogen, sulfur, selenium, and oxygen, such as a 2-pyrazolin-5-one nucleus (e.g., 3-methyl-1-phenyl-2-pyrazolin-5-one, 1-phenyl-1-pyrazolin-5-one, 1-(2-benzothiazolyl)-3-methyl-2-pyrazolin-5-one, etc.); an isoxazolone nucleus (e.g., 3-phenyl-5(4H)-isoxazolone, 3-methyl-5-(4H)-isoxazolone, etc); an oxindole nucleus (e.g., 2,4,6-triketohexahydropyrimidine nucleus (e.g., barbituric acid or 2-thiobarbituric acid as well as their 1-alkyl (e.g., 1-methyl-1-ethyl, 1-propyl, 1-heptyl, etc.) or 1,3-dialkyl (e.g., 1,3-dimethyl, 1,3-diethyl 1,3-dipropyl, 1,3-diisopropyl, 1,3-dicyclohexyl, 1,3-di(β-methoxyethyl), etc., or 1,3-diaryl (e.g., 1,3-diphenyl, 1,3-di(p-chlorophenyl), 1,3-di(p-ethoxycarbonylphenyl), etc.), or 1-aryl (e.g., 1-phenyl, 1-p-chlorophenyl, 1-p-ethoxycarbonylphenyl), etc. or 1-alkyl-3-aryl (e.g., 1-ethyl-3-phenyl, 1-n-heptyl-3-phenyl, etc.) derivatives); a rhodanine nucleus (i.e., 2-thio-2,4-thiazolidinedione series), such as rhodanine, 3-alkylrhodanines (e.g., 3-ethylrhodanine, 3-allylrhodanine, etc.), 3-carboxyalkylrhodanines (e.g., 3-(2-carboxyethyl) rhodanine, 3-(4-carboxybutyl)rhodanine, etc.) 3-sulfoalkylrhodanines (e.g., 3-(2-sulfoethyl)rhodanine, 3-(3-sulfopropyl) rhodanine, 3-(4-sulfobutyl)rhodanine, etc.), or 3-arylrhodanines (e.g., 3-phenylrhodanine, etc.), etc.; a 2(3H)-imidazo-[1,2-a]-pyridone nucleus; a 5,7-dioxo-6, 7-dihydro-5-thiazolo[3,2-a]pyrimidine nucleus (e.g., 5,7-dioxo -3-phenyl-6,7-dihydro-5-thiazolo [3,2-a]pyrimidine, etc.); a 2-thio-2,4-oxazolidinedione nucleus (i.e., those of the 2-thio-2,4(3H,5H)-oxazoledione series) (e.g., 3-ethyl-2-thio-2,4-oxazolidinedione, 3-(2-sulfoethyl)-2-thio-2,4-oxazolidinedione, 3-(4-sulfobutyl)-2-thio-2,4-oxazolidine-dione, 3-(3-carboxypropyl)-2-thio-2,4-oxazolidinedione, etc.); a thianaphthenone nucleus (e.g., 3-(2H)-thianaphthenone, etc.); a 2-thio-2,5-thiazolidinedione nucleus (i.e., the 2-thio-2,5-(3H,4H)-thiazoledione series) (e.g., 3-ethyl-2-thio-2,5-thiazolidinedione, etc.); a 2,4-thiazolidinedione nucleus (e.g., 2,4-thiazolidinedione, 3-ethyl-2,4-thiazolidinedione, 3-phenyl-2,4 thiazolidinedione, 3-α-naphthyl-2,4-thiazolidinedione, etc.); a thiazolidinone nucleus (e.g., 4-thiazolidinone, 3-ethyl-4-thiazolidinone, 3-phenyl-4-thiazolidinone, 3-α-naphthyl-4-thiazolidinone, etc.); a 2-thiazolin-4-one series (e.g., 2-ethyl-mercapto-2-thiazolin-4-one, 2-alkylphenylamino-2-thiazolin-4-one, 2-diphenylamino-2-thiazolin-4-one, etc.); a 2-imino-4-oxazolidinone (i.e., pseudohydantoin)) nucleus; a 2,4-imidazolidinedione (hydantoin) series (e.g., 2,4-imidazolidinedione, 3-ethyl-2,4-imidazolidinedione, 3-phenyl-2,4-imidazolidinedione, 3-naphthyl-2,4-imidazolidinedione, 1,3-diethyl-2,4-imidazolidinedione, 1-ethyl-3-phenyl-2,4-imidazolidinedione 1-ethyl-3-naphthyl-2,4-imidazolidinedione, 1,3-diphenyl-2,4-imidazolidinedione, etc.); a 2-thio-2,4-imidazolidinedione (i.e., 2-thiohydantoin) nucleus (e.g., 2-thio-2,4-imidazolidinedione, 3-ethyl-2-thio-2,4-imidazolidinedione, 3-(4-sulfobutyl)-2-thio-2,4-imidazoidinedione, 3-(2-carboxyethyl)-2-thio-2,4-imidazolidinedione, 3-phenyl-2-thio-2,4-imidazolidinedione, 3-naphthyl-2-thio-2,4-imidazolidinedione, 1,3-diethyl-2-thio-2,4-imidazolidinedione, 1-ethyl-3-phenyl-2-thio-2,4-imidazolidinedione, 1-ethyl-3-naphthyl-2-thio-2,4-imidazolidinedione, 1,3-diphenyl-2-thio-2,4-imidazolidinedione, etc.); a 2-imidazolin-5-one nucleus (e.g., 2-propylmercapto-2-imidazolin-5-one, etc.), etc. (especially useful are nuclei wherein Q represents a heterocyclic nucleus containing 5 atoms in the heterocyclic ring, 3 of said atoms being carbon atoms, 1 of said atoms being a nitrogen atom, and 1 of said atoms being selected from the group consisting of a nitrogen atom, an oxygen atom, and a sulfur atom).

L represents a cation nucleus of 1-alkyl-2-phenylindol-3-yl, 1-aryl-2-phenylindol-3-yl, 1-alkyl or aryl-2-phenyl-5-nitro-indol-3-yl, 1-alkyl-2-phenyl-5-phenylsulfonylindol-3-yl, 1-aryl-2-phenyl-5-phenylsulfonylindol-3-yl, 1-aryl-2-phenyl-5-phenylsulfonylindol-3-yl, 1-alkyl-2-phenyl-5-benzoylindol-3-yl, 1-aryl-2-phenyl-5-benzoylindol-3-yl, 9-methyl-carbazol-3-yl, 2-alkyl or substituted alkyl-3-phenyl-5-oxo-3-isooxazolin-4-yl, 2-alkyl or substituted alkyl-3-furyl-5-oxo-3-isoxazolin-4-yl, 2-alkyl or substituted alkyl-3-thienyl-5-oxo-3-isoxazolin-4-yl, 2-alkyl or substituted 3-pyrryl-5-oxo-3-isoxazolin-4-yl, 1-aryl-3,5-dialkylpyrazol-4-yl series.

Surprisingly the counterion (the acid anion, $X^-$) has been found to significantly affect the sensitizing ability of the dyes according to the present invention. The reason for this is not understood. The general order of preference for the anions is perchlorate (most preferred), tetrafluoroborate, p-toluenesulfonate, methylsulfate, sulfamate, iodide, bromide, and chloride.

With regard to the above mentioned substituent groups (i.e., R, $R_1$, $R_2$, $R_3$, $R_4$, $R_5$, Z, Q, L and $X^-$) the size of such groups is not believed to be of any substantial significance in the practice of this invention. Size changes may only require modification of solvents necessary to include them in photosensitive systems, but the action of these dyes is believed to be substantially the same, without regard to size. However, for purposes of economics, the following moiety sizes are generally preferred. The second nucleus (heterocyclic or paraaminophenyl) should contain no more than 50 carbon atoms and no more than 10 non-metallic heteroatoms such as nitrogen, sulfur and oxygen (metal atoms may appear in these groups only in the form of salts). It is more preferred that such second nucleus contains no more than 30 carbon atoms and most preferred no more than 20 carbon atoms. For groups R and $R_1$ it is generally preferred to have no more than 18 carbon atoms and most preferred to have no more than 10 carbon atoms. For group $R_2$ (when benzoyl and phenyl-sulfonyl) the generally preferred aryl groups of this invention are phenyl and naphthyl and derivatives thereof. $R_4$ and $R_5$ are preferred to have no more than 6 carbon atoms each. None of $R_2$, $R_4$ and $R_5$ should contain metal atoms.

The preferred dyes are those of U.K. Pat. No. 1,555,053 in which the imidazo-[4,5-b]quinoxaline cyanine dye bears a 5-phenylsulfonyl or 5-benzoyl substituent.

Various binder materials known in the art are useful with the electronically active electron donor compounds of the present invention. It is of course preferred that the binder be essentially optically transparent or at least transparent to the wavelengths of radiation to which the compounds (sensitized or not) are sensitive. Amongst the useful binders are poly(vinyl chloride), poly(siloxanes), poly(vinyl butyral), poly(vinyl acetate), styrene/acrylonitrile copolymers, polyacrylates, polymethacrylates polycarbonates, polyepoxides, polyurethanes, polyamides, polyethers, polyesters, polyolefins as well as block, graft, random, and alternating polymers, copolymers, terpolymers and mixtures thereof and the like. The binders are preferably electrically inactive themselves. The preferred polymeric binders are polycarbonates, polyesters, and styrene/acrylonitrile copolymers. Coating aids, lubricants, surface active agents, and other adjuvants may be added to the composition.

For use of the materials of the present invention as electrophotographic layers, the organic electron donor compounds should be present as at least 20 percent by weight of the composition. Preferably the donor compound should be present as at least 25 or 35 percent by weight of the layer, and may comprise up to 100% by weight of the layer, excluding of course the sensitizer dye. The sensitizing dyes should be used in amounts which will increase the sensitivity of the composition. This is defined as an effective sensitizing amount of dye. Ordinarily amounts of up to 10% by weight dye may be used, but certain constructions can be envisaged with as much as 90% by weight of dye and 10% by weight of organic electron donor compounds. Amounts of dye as small as 0.005 percent by weight can be useful. More preferred concentration ranges are between 0.05 and 5 percent by weight.

The photosensitive materials of the present invention may also be useful as photoconductive toners, photovoltaic devices, organic semiconductors, and the like, and may use concentrations of organic electron donor compounds as low as 5 percent by weight.

It has been surprisingly noted that the benzocarbazole-aldehyde condensation products useful in the present invention are better charge transport materials than the corresponding benzocarbazoles by themselves. This is susprising because it is the benzocarbazole nucleus which is the electronically active portion of both molecules. Even when benzocarbazoles were used in reasonably higher molecular proportions to the binder than were the condensates, the condensates would still perform better.

These and other aspects of the present invention will be shown in the following examples.

EXAMPLE 1

Synthesis of bis-5,5'-(N-ethylbenzo[a]carbazolyl)phenylmethane

Into a round bottom flask equipped with a reflux condenser and a mechanical stirrer were added 22.4 grams (0.1 mole) of N-ethylbenzo[a]carbazole and 5.3 grams (0.05 mole) of benzaldehyde. Two hundred milliliters of ethanol acidified with 8 ml of concentrated hydrochloric acid were then added. The mixture was stirred at reflux under a nitrogen atmosphere for sixteen hours. The insoluble, pure white product was isolated by filtration, washed with 100 ml of ethanol, and dried in a vacuum oven. The yield was 95% of the theoretic calculation.

EXAMPLES 2–17

In a manner substantially identical to that of the previous example, electronically active electron donor compounds of the present invention were obtained by condensing N-ethylbenzo[a]carbazole with each of the following aldehydes in equimolar replacement for the benzaldehyde:

2. p-tolualdehyde
3. m-tolualdehyde
4. o-tolualdehyde
5. p-anisaldehyde
6. m-anisaldehyde
7. o-anisaldehyde
8. p-chlorobenzaldehyde
9. p-bromobenzaldehyde
10. o-bromobenzaldehyde
11. p-hydroxybenzaldehyde
12. α-naphthaldehyde
13. veratraldehyde
14. p-octyloxybenzaldehyde
15. iso-butyraldehyde
16. n-nonylaldehyde
17. terphthaldehyde

EXAMPLES 18–21

In a manner substantially identical to that of Example 1, the following combinations of carbazoles and aldehydes were used to synthesize compounds of the present invention.

18. benzo[a]carbazole and benzaldehyde
19. N-ethylbenzo[b]carbazole and benzaldehyde
20. N-ethyldibenzo[a]carbazole and benzaldehyde
21. N-ethyl-8-methoxybenzo[a]carbazole and benzaldehyde The addition of any of the compounds produced in Examples 1–21 to electrically inert polymeric binders formed positive charge transport layers. These layers could be formed on photoconductive layers and were capable of supporting injected photogenerated holes from the photoconductive layer and allowed the transport of these holes through the transport layer to selectively discharge the surface charge.

EXAMPLES 22–39

Bulk sensitized photoreceptors were prepared by coating a solution consisting of 0.5 percent by weight solids of dye, 40 percent by weight of the same charge transport compound prepared in Example 1, and 59.5 percent of an organic solvent soluble polyester resin from a dichloromethane, 1,2-dichloroethane (50/50) solution were coated at about $1\times10^{-4}$ m wet thickness onto an aluminum coated polyethyleneterephthalate film. The sample was air dried at 85° C. for approximately 15 minutes. The photoreceptor charged to a maximum voltage ($V_o$) under positive corona charging and the exposure energy and wavelength of radiation necessary to reduce the charge to one half $V_o$ ($V_f$) with little dark decay was recorded. The device was also found to display high charge acceptance, low dark decay, and negligible fatigue upon cycling.

The following dye compounds were used in these examples.

The results are shown in Table I. Where the dyes had multiple peaks of absorbance, multiple readings were taken and the values for exposure energy and wavelength respectively given.

TABLE I

| Example | $V_o$ (volts) | Exposure Energy (ergs/cm$^2$) | Wavelength (nm) |
|---|---|---|---|
| 22 | 861 | 55 | 500 |
| 23 | 697 | 70 | 550 |
| 24 | 830 | 32, 57, 116 | 621, 500, 650 |
| 25 | 840 | 33, 54, 68 | 621, 650, 600 |
| 26 | 820 | 18, 29, 32 | 621, 600, 650 |
| 27 | 875 | 73, 113, 119 | 621, 600, 650 |
| 28 | 800 | 100 | 621 |
| 29 | 860 | 39, 41, 66 | 650, 621, 600 |
| 30 | 900 | 100, 117 | 600, 621 |
| 31 | 900 | >100 | 650 |
| 32 | 750 | 38, 56, 57 | 621, 650, 600 |
| 33 | 861 | 35, 33, 46 | 600, 633, 650 |
| 34 | 875 | 75, 125 | 600, 621 |
| 35 | 900 | 49, 69, 104 | 650, 621, 600 |
| 36 | 1030 | 44, 47, 57 | 600, 633, 650 |
| 37 | 392 | 137 | 725 |
| 38 | 960 | 85, 39 | 700, 750 |
| 39 | 600 | 38, 51, 190 | 750, 700, 800 |

The general effectiveness of the dyes of the present invention as sensitizers for electron donors is shown by these examples.

The results of these experiments show that the sensitizing abilities of imidazo [4,5-b] quinoxaline cyanine dyes for organic electron donors are improved by the substitution of the phenyl ring on the imidazo [4,5-b] quinoxaline nucleus with a phenylsulfonyl or benzoyl group. It must be noted, in order to appreciate the data, that this is independent of the additional effect of counterions (anions) on the sensitizing ability of these cyanine dyes. As previously noted, certain counterions (and especially perchlorate) are preferred. As shown in Examples 35 and 36, the same quaternary nitrogen containing cyanine dye displayed improved sensitizing ability for organic electron donor compounds when the para-toluenesulfonate counterion was replaced with a perchlorate anion. However, comparisons are meaningful between, for example, the compounds of Examples 25 and 35 where the nitro groups of the prior art are replaced with phenylsulfonyl groups according to the present invention and the counterion is the same as in both cases. As can be seen from the data, the exposure energy necessary to reach one-half the initial voltage was lower for the phenylsulfonyl compound at all absorbance wavelengths. This shows the improvement in sensitivity alleged in the practice of the present invention. The comparison of compounds 25 to compounds 35 (with only hydrogens on the phenyl ring) and 24 (with chlorine substituents on the phenyl ring) show similar improvement at the absorption wavelengths evaluated. Example 25 shows improved properties at its wavelength of maximum absorbance (621) in comparison to the wavelength of maximum absorbance (650) for compound 29.

EXAMPLE 40

A solution consisting of 0.6 g of an organic solvent soluble copolyester derived from terephthalic acid, isophthalic acid, and ethylene glycol (Vitel PE-200), 0.4 g of bis-5,5'-(N-ethylbenzo[a]carbazolyl) phenylmethane and 0.005 g of phenylsulfonylimidazo [4,5-b]-quinoxaline dye (A) in a mixture of 4.5 g of dichloromethane and 4.5 g of 1,2-dichloroethane was prepared, filtered, and knife coated onto an aluminized polyester substrate. The wet thickness of the coating was 4 mil ($1\times10^{-4}$m). The coating was allowed to air dry and then was oven dried for 15 min. at 80° C. The electrophotographic performance of this construction is shown in Table II.

EXAMPLES 41–48

A solution consisting of 0.6 g polyester (Vitel PE-200), 0.4 g of the charge transport material indicated in Table II, and 0.005 g a phenylsulfonylimidazo-[4,5-b]-quinoxaline dye (A) in a mixture of 4.5 g of dichloromethane and 4.5 g of 1,2-dichloroethane was prepared, filtered, and knife coated onto an aluminized polyester substrate. The wet thickness of the coating was 4 mil ($1\times10^{-4}$m). The coating was allowed to air dry and then oven dried for 15 min. at 80° C. The electrophotographic behavior of this construction is shown in Table II.

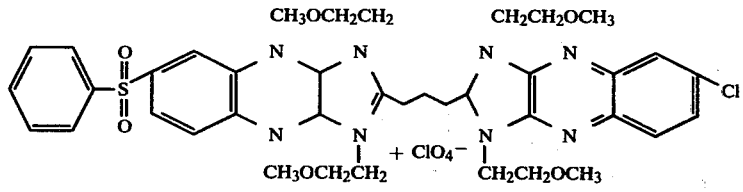

EXAMPLE 49

A solution consisting of 1.0 g of polyvinylcarbazole and 0.005 g of phenylsulfonylimidazo-[4,5-b]-quinoxaline dye (A) in a mixture of 4.5 g dichloromethane and 4.5 g of 1,2-dichloroethane was knife coated onto an aluminized polyester substrate. The wet thickness of the coating was 4 mil ($1\times10^{-4}$m). The coating was air dried and then oven dried for 15 min. at 80° C. The electrophotographic behavior of the construction is shown in Table II.

TABLE II

| Example | Dye | Transport Material | Wavelength | Exposure to Vo/2 | Vo |
|---|---|---|---|---|---|
| 40 | A | Bis-5,5'-(N—ethylbenzo[a]carbazolyl)-pheneylmethane | 620 nm | 30 ergs/cm$^2$ | 930 |
| 41 | A | Bis-5,5'-(N—propylbenzo[a]carbazolyl)-phenylmethane | 620 nm | 32.4 ergs/cm$^2$ | 1016 |
| 42 | A | Bis-5,5'-N—ethylbenzo[a]carbazolyl)-m-methoxyphenylmethane | 620 nm | 35.6 ergs/cm$^2$ | 1076 |
| 43 | A | 1,5-diphenyl-3-styrylpyrazoline | 620 nm | 30.9 ergs/cm$^2$ | 1000 |
| 44 | A | 1-phenyl-3-(p-methoxystyryl)-5-(p-methoxyphenyl)pyrazoline | 620 nm | 80.3 ergs/cm$^2$ | 966 |
| 45 | A | 4,4-bis(diethylamino)-2',2''-dimethyltriphenylmethane | 620 nm | 297 ergs/cm$^2$ | 938 |
| 46 | A | N,N,N',N'—tetrabenzyl-m-phenylenediamine | 600 nm | 888 ergs/cm$^2$ | 1115 |

TABLE II-continued
| Example | Dye | Transport Material | Wavelength | Exposure to Vo/2 | Vo |
|---|---|---|---|---|---|
| 47 | A | 2,5-bis-(p-diethylaminophenyl)-1,3,4-oxadiazole | 620 nm | 72 ergs/cm$^2$ | 1055 |
| 48 | A | p-diethylaminobenzaldehyde-(diphenylhydrazone) | 620 nm | 41.1 ergs/cm$^2$ | 1000 |
| 49 | A | polyvinylcarbazole | 620 nm | 20.5 ergs/cm$^2$ | 640 |
22
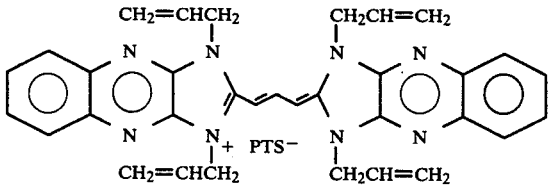
23
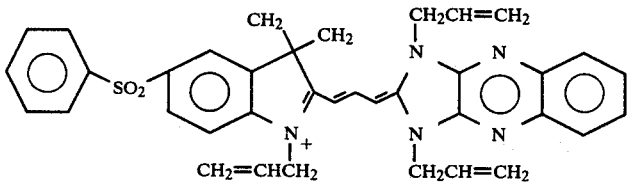
p-toluenesulfonate (hereinafter PTS$^-$)
24
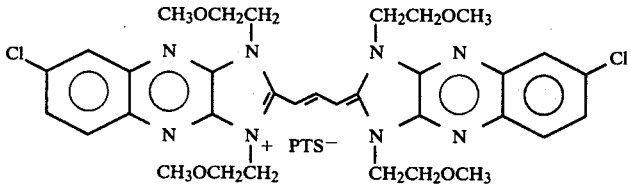
25
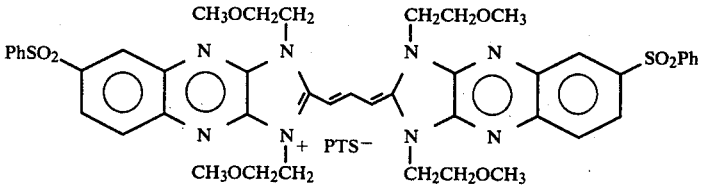
26
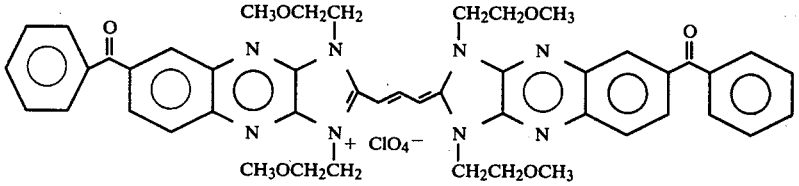
27
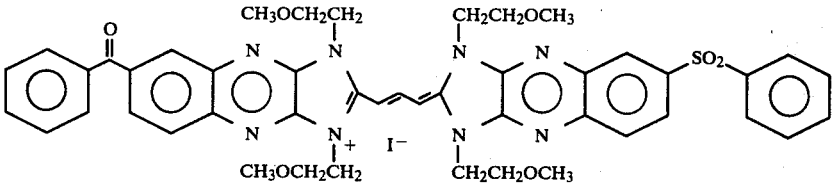
28
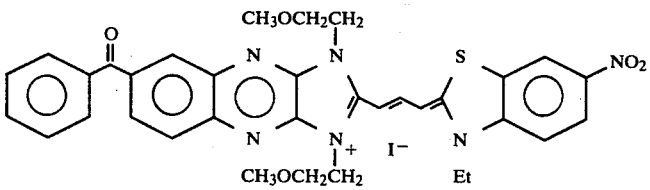

-continued
29
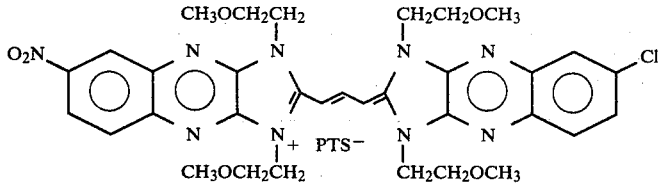
30
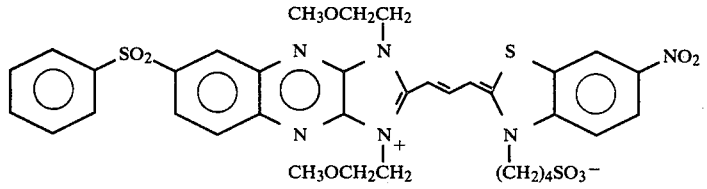
31
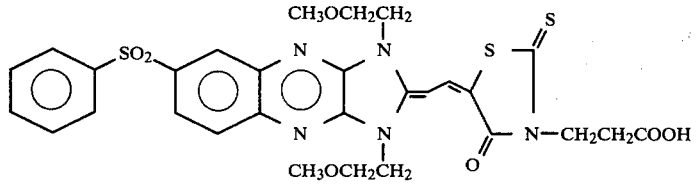
32
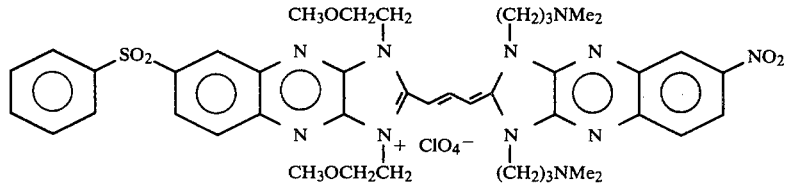
33
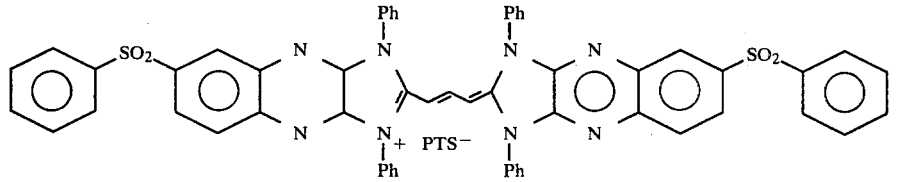
34
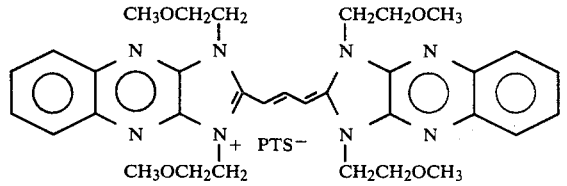
35
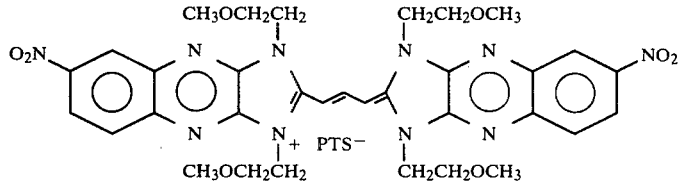
36
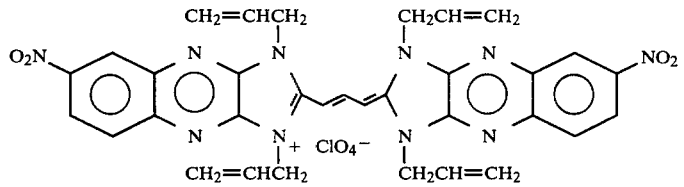

-continued

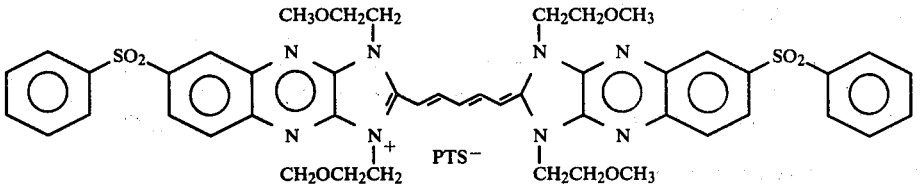

37

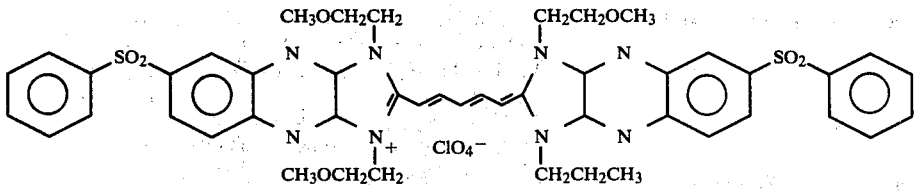

38

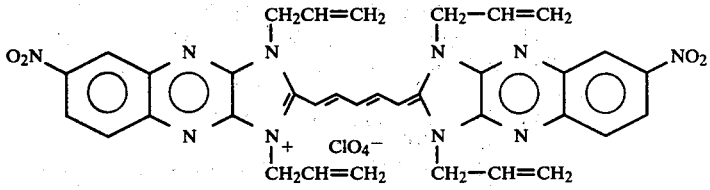

39

We claim:

1. A photosensitive layer comprising an organic electronically active electron donor compound sensitized with a sensitizing amount of an imidazo-[4,5-b]quinoxaline cyanine dye having at least one phenylsulfonyl or benzoyl substituent on an imidazo-[4,5-b]quinoxaline nucleus.

2. The layer of claim 1 wherein said phenylsulfonyl or benzoyl substituent is on the 6- or 7-position of the imidazo-[4,5-b]quinoxaline nucleus.

3. The layer of claim 2 wherein said donor compound is a polyvinyl carbazole.

4. The layer of claim 2 wherein said donor compound is present in an electronically inactive polymeric binder.

5. The layer of claim 2 wherein said donor compound is a benzocarbazole derivative of the formula

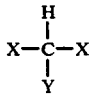

where X is

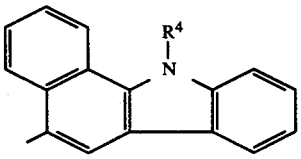

or

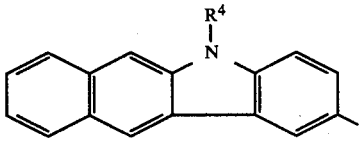

wherein $R^4$ and Y are independently elected from the group consisting of aliphatic, aromatic, heterocyclic, and mixed aliphatic-aromatic groups.

6. The layer of claims 2, 3, or 4 in which said imidazo-[4,5-b]quinoxaline cyanine dye is represented by any of the formula:

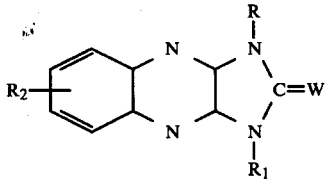

wherein W represents:

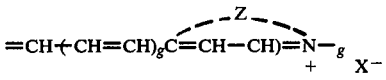

(I)

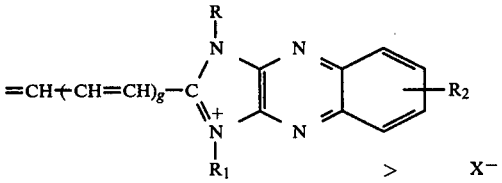

(II)

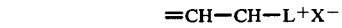

(V)

in which g represents 1, 2 or 3;

R and $R_1$, which may be the same or different, each represents an aliphatic substituent or a phenyl group;

$R_2$ represents a phenylsulfonyl or a phenylcarbonyl group substituted in 6 or 7 position;

Z represents the atoms necessary to complete a nucleus from the group consisting of thiazole, benzothiazole, naphthothiazole, oxazole, benzoxazole, naphthoxazole, selenazole, benzoselenazole, thiazoline, pyridine, indolenine, 2-quinoline, 4-quinoline, 1-isoquinoline, 1,1-dialkyl-indolenine, imidazole, benzimidazole, naphthimidazole, imidazo-[4,5-b]-quinoxaline, 3H-pyrrolo-[2,3-b]-pyridine, 3H-nitro-indole, and thiazole-[4,5-b]-quinoline;

$R_3$ represents an aliphatic group or a phenyl group;

L represents a cation nucleus selected from the group consisting of indole, carbazole, isoxazole and pyrazole groups and wherein $X^-$ represents an acid anion.

7. The emulsion of claim 6 wherein W represents

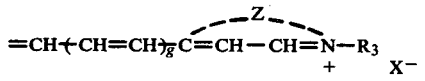

and g is 1 or 2.

8. The layer of claim 6 wherein W represents

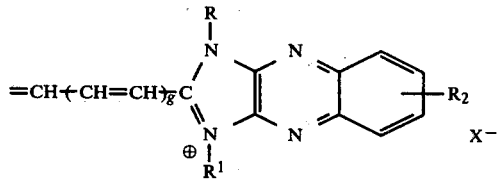

9. The layer of claim 6 wherein W represents $=CH-CH-L^+X^-$.

10. The layer of claim 7 wherein g is 1, z is selected from the group consisting of thiazole, benzothiazole, oxazole and benzoxazole.

11. The layer of claim 8 wherein g is 1, and both R and $R_1$ are the same aliphatic substituent.

12. The emulsion of claim 8 wherein g is 1 and both R and $R_1$ are the same phenyl group.

13. The emulsion of claim 9 wherein L is isoxazole.

14. The emulsion of claim 6 in which $R_2$ is a phenylsulfonyl group.

15. The layer of claim 10 in which $R_2$ is a phenylsulfonyl group.

16. An electrophotographic article comprising a substrate having in sequence on at least one surface thereof a conductive layer and the photosensitive layer of claims 1, 2, 4, 7 or 8.

* * * * *

UNITED STATES PATENT AND TRADEMARK OFFICE

CERTIFICATE OF CORRECTION

PATENT NO. : 4,356,244

DATED : October 26, 1982

INVENTOR(S) : Louis M. Leichter, Terry J. Sonnonstine, John J. Stofko, Jr. and Paolo Beretta It is certified that error appears in the above—identified patent and that said Letters Patent is hereby corrected as shown below:

Column 12, before the structural drawing (approximately line 39), insert the sentence --Dye (A) has the structure--.

Signed and Sealed this

*Eleventh* Day of *January 1983*

[SEAL]

*Attest:*

GERALD J MOSSINGHOFF

*Attesting Officer*

*Commissioner of Patents and Trademarks*